US005942706A

United States Patent [19]

Leckie

[11] Patent Number: 5,942,706

[45] Date of Patent: Aug. 24, 1999

[54] COLLAPSIBLE AND RECHARGEABLE MUSIC SHEET SCROLL

[76] Inventor: Franklin Leckie, 110 Parkdale Dr., Greenville, S.C. 29611

[21] Appl. No.: 09/187,449

[22] Filed: Nov. 6, 1998

[51] Int. Cl.[6] ..... G10G 7/00

[52] U.S. Cl. ..... 84/487; 84/486; 40/518

[58] Field of Search ..... 84/486, 487, 488, 84/489, 499, 500, 501, 502, 503, 504, 505, 506, 507, 508, 509, 510, 511, 512, 513, 514, 515, 516, 517, 518, 519, 520, 521; 40/518, 343

[56] References Cited

U.S. PATENT DOCUMENTS

| | | | |
|---|---|---|---|
| D. 385,900 | 11/1997 | Lyle | D17/9 |
| 656,478 | 8/1900 | Schaffer et al. | 84/486 |
| 1,430,509 | 9/1922 | Jones | 40/518 |
| 3,224,127 | 12/1965 | Hutterer | 40/86 |
| 3,882,620 | 5/1975 | Grindle | 40/343 |
| 4,020,576 | 5/1977 | Dickey | 40/86 R |
| 4,862,614 | 9/1989 | Shettleroe | 40/593 |
| 4,922,223 | 5/1990 | Prevot | 340/473 |
| 5,003,717 | 4/1991 | Trame et al. | 40/518 |
| 5,052,266 | 10/1991 | Burster | 84/493 |
| 5,174,055 | 12/1992 | Aiken | 40/518 |
| 5,233,900 | 8/1993 | Fitzgerald | 84/497 |
| 5,347,735 | 9/1994 | Pratt | 40/518 |
| 5,373,772 | 12/1994 | Shemoul | 84/486 |
| 5,515,631 | 5/1996 | Nardy et al. | 40/518 |
| 5,575,097 | 11/1996 | Chou et al. | 40/531 |
| 5,687,498 | 11/1997 | Keyser et al. | 40/518 |

FOREIGN PATENT DOCUMENTS

| | | |
|---|---|---|
| 77524 | 6/1918 | Austria . |
| 176808 | 1/1906 | Germany . |
| 679-658 | 10/1989 | Switzerland . |
| 9510 | 3/1910 | United Kingdom . |

*Primary Examiner*—William M. Shoop, Jr.
*Assistant Examiner*—Wesley Scott Ashton
*Attorney, Agent, or Firm*—Hardaway/Mann IP Group; Nexsen Pruet Jacobs & Pollard, LLP

[57] ABSTRACT

The present invention, a sheet music turning apparatus, comprises a base, a first spindle on one end of the base, and a second spindle opposite the first spindle on the base. A rotation means for rotating the first spindle in a direction is also provided such that a supply of sheet music mounted on the second spindle is transferred to the first spindle by the rotation of the first spindle, thereby causing consecutive pages of sheet music to be viewed.

16 Claims, 4 Drawing Sheets

COLLAPSIBLE AND RECHARGEABLE MUSIC SHEET SCROLL

FIELD OF THE INVENTION

This invention relates generally to the field of sheet music turners, and more particularly to a sheet music turning apparatus for turning a spool of sheet music.

BACKGROUND OF THE INVENTION

Sheet music is normally provided in book form such that you have consecutive pages of music which can only be read by turning pages. Prior inventions for turning book pages as well as music pages are plentiful. For example, U.S. Pat. No. D385,900 discloses a music turner foot pedal. U.S. Pat. No. 5,575,097 discloses a page turning device. U.S. Pat. No. 5,373,772 discloses a page turner. U.S. Pat. No. 5,233,900 discloses a music page turner. U.S. Pat. No. 5,052,266 discloses a turner for sheet music. U.S. Pat. No. 5,052,266 discloses a turner for music manuscripts. Although page and music turners are present in the prior art, there remains room for improvement in the art.

SUMMARY OF THE INVENTION

The present invention overcomes the problems and disadvantages of the prior art by providing a sheet music turning apparatus which takes music which has been arranged in consecutive-page format within an enclosure and scrolling those pages before the reader at a speed which is dictated and controlled by the reader.

It is, thus, an object of the present invention to provide a sheet music turning apparatus which can scroll consecutive music pages before a reader.

It is also an object of the present invention to provide a sheet music turning apparatus where the speed at which the pages are scrolled before the reader is controlled by the reader.

It is a further object of the present invention to provide a sheet music turning apparatus which can be folded and compactly stored.

It is an even further object of the present invention to provide a sheet music turning apparatus which can support numerous pages of sheet music at a particular time.

These, and other objects, are accomplished by providing a sheet music turning apparatus comprising a base, a first spindle on one end of the base, and a second spindle opposite the first spindle on the base. A rotation means for rotating the first spindle in a direction is also provided such that a supply of sheet music mounted on the second spindle is transferred to the first spindle by the rotation of the first spindle, thereby causing consecutive pages of sheet music to be viewed.

DETAILED DESCRIPTION OF THE INVENTION

Figure 1:
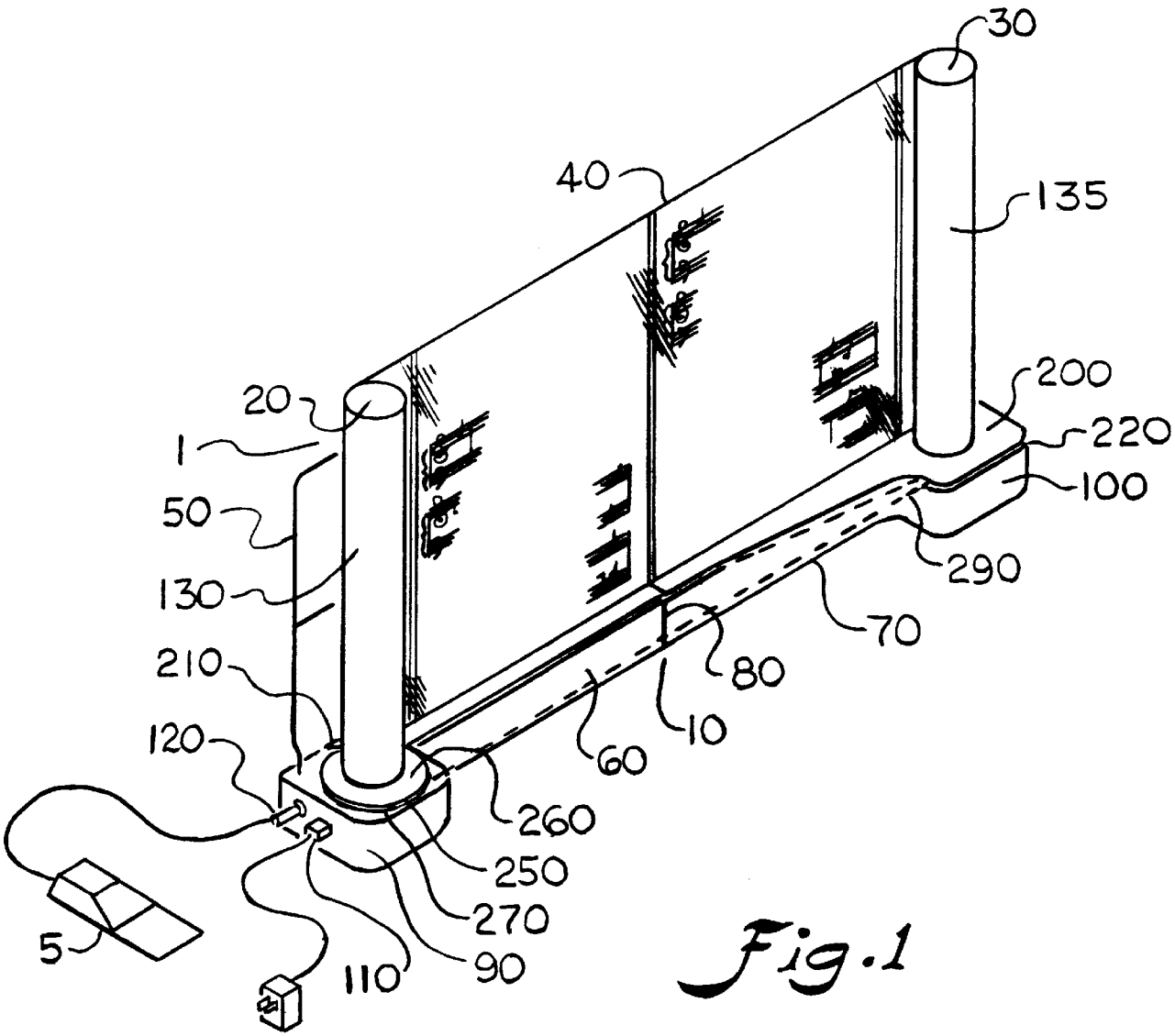
FIG. 1 is a front perspective view of a preferred embodiment of the invention.

The preferred embodiment of the present invention, as shown in FIG. 1 of the drawings, discloses a sheet music turning apparatus 1. The turning apparatus 1 includes a base member 10. Base member 10 is made of a sturdy, durable material such as plastic, wood, metal or any other suitable material. Atop the base member 10 is provided a first spindle 20 and a second spindle 30. First spindle 20 and second spindle 30 can be constructed of a variety of materials such as plastic, cardboard, wood, metal, or any other material suitable to perform the function of the spindles 20 or 30. First spindle 20 and second spindle 30 are preferably tubular in shape having a diameter. The spindles 20 and 30 are also, preferably, hollow but are not required to be thus.

Figure 5:
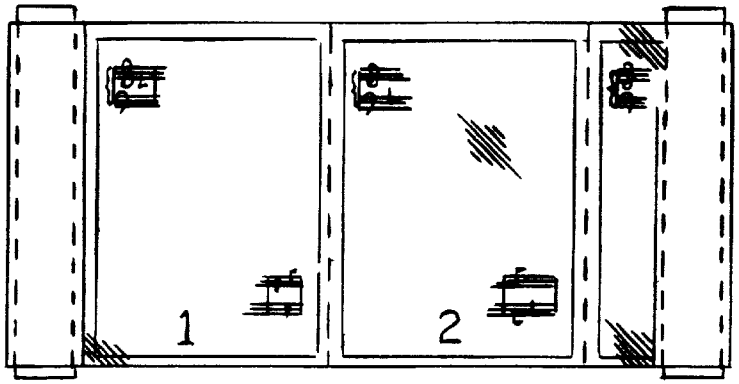
FIG. 5 is a front elevation view of the sheet music enclosure element.

A sheet music enclosure 40 is positioned between the first spindle 20 and the second spindle 30 and is also spooled around both the first spindle 20 and the second spindle 30. (Note that spooled, as used in this application, means to wrap around.) The sheet music enclosure 40 should be a transparent material. In a preferred embodiment, the sheet music enclosure 40 may be segmented to hold individual sheets of music as shown in FIG. 5. However, the sheet music enclosure 40 may be one single piece of transparent material with no segmentation. The sheet music holder may also be individual strips of transparent material holding the pages of the music together in a consecutive fashion. The base 10 may also comprise a support member 50, preferably a stand-off. However, the installation of stand-off 50 is optional. Stand-off 50 is useful in preventing the sheet music from contacting adjacent surfaces and, thus, damaging the sheet music or disrupting the rotation of the sheet music.

Figure 2A:
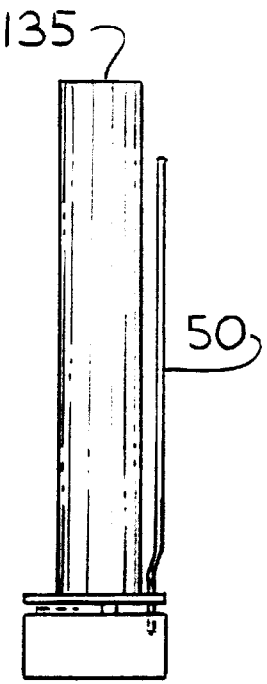
FIG. 2*a* is a side elevation view of the second spindle and guide element.
Figure 2:
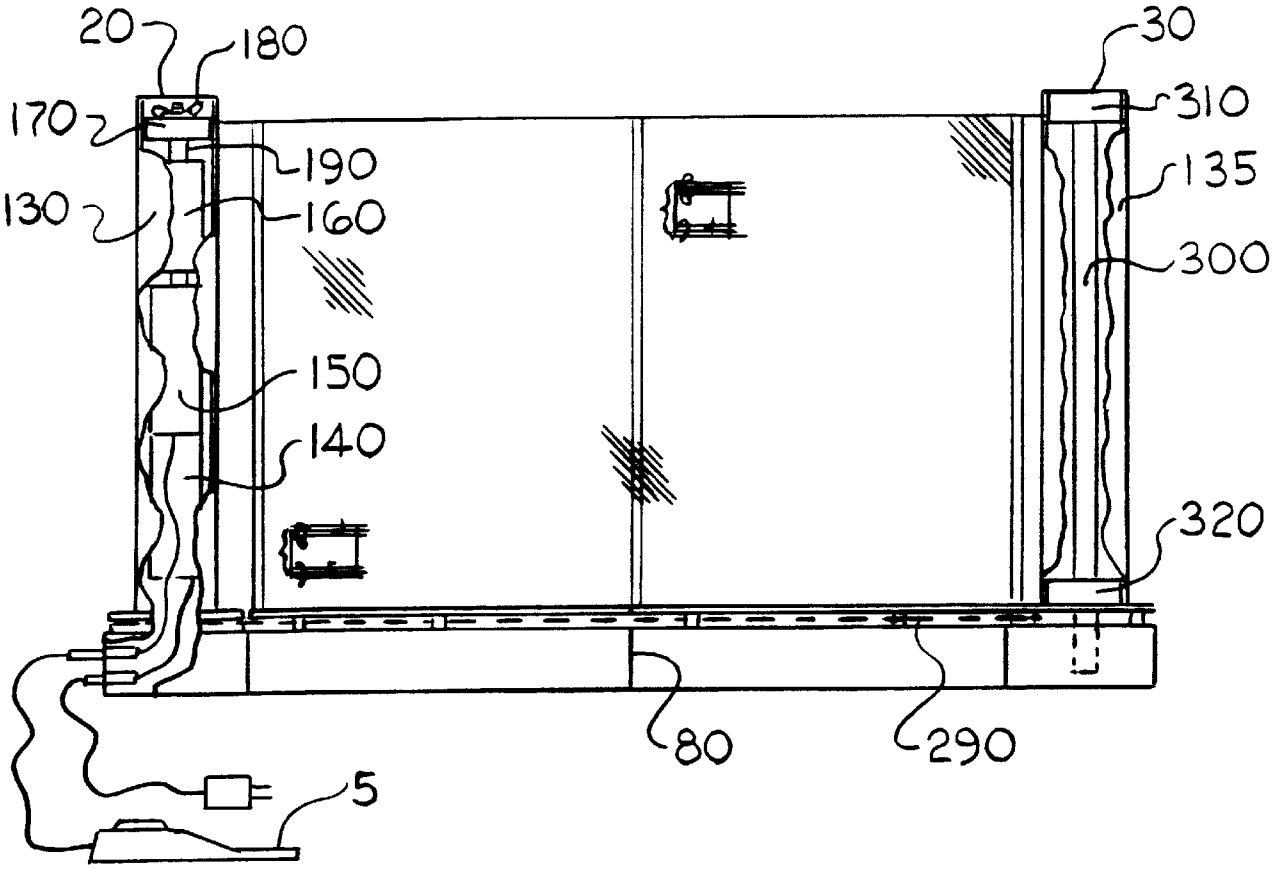
FIG. 2 is a broken-away front elevation view of the spindle elements.
Figure 6:
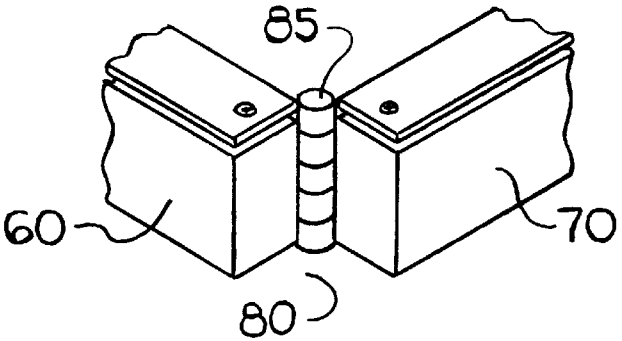
FIG. 6 is a front perspective view of the hinged opening of the base element.

As further disclosed in FIG. 1 and FIG. 2 of the drawings, the base member 10 comprises a first end 60, a second end 70 and a connecting means 80, such as a hinged opening. Ends 60 and 70 are not required to be connected as the turning apparatus 1 will function as designed even if both ends 60 and 70 are completely separable parts. When the turning apparatus 1 is not in use, the apparatus may be compactly stored by folding the first end 60 onto the second end 70 at connecting means 80 (FIG. 6). Base member 10 further comprises a first leg 90 and a second leg 100. First leg 90 and second leg 100 provide support for the weight of the turning apparatus 1 and are designed such as to avoid forward tipping of the apparatus during use.

As better seen in FIG. 2 of the drawings, first spindle 20 further comprises cover 130. Enclosed within cover 130 is a power source 140, such as a battery, a rechargeable battery or a direct connection to a conventional power outlet. Power source 140 is mounted on shaft 190 in communication with first coupling 110. If a rechargeable battery is used, power source 140 may be connected to a conventional outlet for purposes of recharging at first coupling 110. Also enclosed within cover 130 is a motor 150, also mounted on shaft 190. Motor 150 is preferably a variable speed motor and is positioned adjacent the power source 140 and derives its power from such source 140. Motor 150 is in further communication with second coupling 120 such that an apparatus, such as a foot pedal 5, is attached and the user of the music turner can control the speed at which the motor 150 rotates first spindle 20 and, thus, rotates the sheet music.

Further enclosed within cover 130, on shaft 190, is a drive 160. Drive 160 is located adjacent the motor 150. Also mounted on shaft 190, adjacent drive 160, is clutch 170. The shaft 190 is secured in communication with an upper portion of clutch 170 by a fastener 180. The fastener 180 may be any suitable fastener, such as a threaded rod and wing nut. In any instance, the battery 140, motor 150, drive 160 and clutch 170 function to rotate first spindle 20 in a direction consistent with the direction in which sheet music is read.

As also seen in FIG. 2 and FIG. 2*a,* second spindle 30 comprises a cover 135 enclosing an inner spindle 300, a top member 310 and a bottom member 320, the top 310 and bottom 320 members providing stability for cover 135. Cover 135 has a diameter which is slightly larger than top and bottom members 310 and 320 such that cover 135 can enclose and rotate about members 310 and 320 and yet maintain its position on base 10 without any vertical or horizontal movement. In an alternate embodiment, second spindle 30 can be stationary allowing only the sheet music enclosure 40 to rotate about cover 135. In any instance, second spindle 30 should be responsive to forces exerted by first spindle 20 such that sheet music is spooled or transferred from second spindle 30 to first spindle 20.

Figure 3:
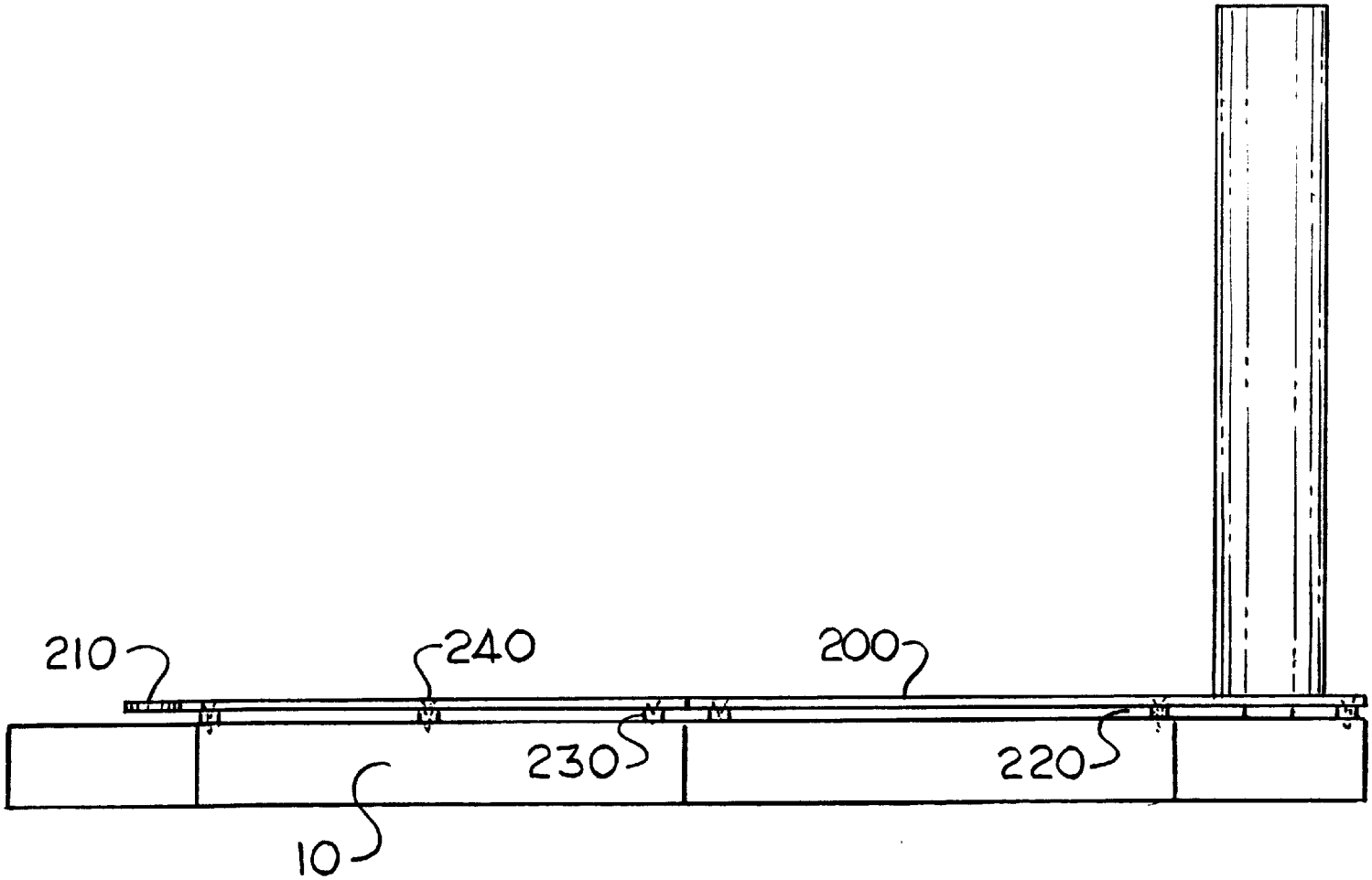
FIG. 3 is a front elevation view of the shelf to base mounting.

The construction of the apparatus 1 as seen in FIG. 1 is further described with reference to FIG. 3. The turning apparatus 1, as seen in FIG. 1, comprises a shelf member 200. Shelf member 200 extends over base member 10 from second leg 100, over second end 70 and first end 60. At first leg 90, shelf 200 extends in an arcuate fashion 210 around first spindle 20 on first leg 90. Shelf member 200 provides a mounting support for second spindle 30 and defines an aperture 220 between the shelf 200 and base 10. As shown in FIG. 3, shelf 200 may be mounted onto base 10 in a number of places. In a preferred embodiment, shelf 200 is mounted onto support member 230. A fastener 240 is placed in communication with shelf 200 and support member 230 such that the shelf 200 is secured in place. Alternate means for securing the shelf 200 to the base may be utilized, such as nails or glue.

Figure 4:
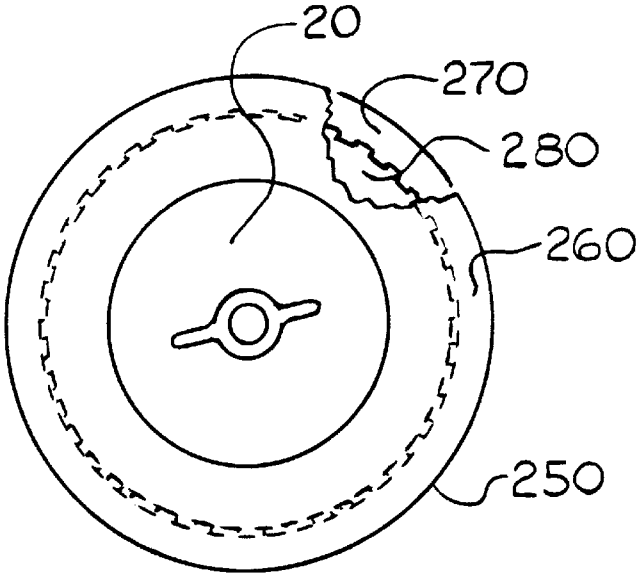
FIG. 4 is a top plan view of the rotating base of the first spindle element.

As shown in FIG. 4 of the drawings, first spindle 20, which provides the rotational force for "turning" or scrolling the sheet music pages, comprises a rotating base member 250. Rotating base 250 comprises an upper member 260, a lower member 270 and a grooved member 280. Grooved member 280 has a diameter which is less than the diameter of upper member 260 and lower member 270 so as to accommodate a manual means for turning the first spindle 20 upon malfunction or discharge of battery 150. In a preferred embodiment, as seen in FIG. 1, the first spindle 20 may be manually turned by using a manual turning means 290, such as a tether, a string, a rope, etc., in communication with rotating base 250 at grooved member 280 and with aperture 220. In this manual configuration, manual turning means 290 is physically pulled in a direction consistent with the manner in which sheet music is read. As tether 290 is manually engaged, tether 290 engages grooved member 280 causing the first spindle 20 to rotate and, thus, scrolling the sheet music from spindle 30. In an alternate embodiment, first spindle 20 may be manually scrolled by actually engaging first spindle 20 with the hand and turning first spindle 20 in an appropriate direction. The sheet music may also be reversed in this same fashion by manually manipulating second spindle 30 in an appropriate or reversed direction.

It is, thus, seen that a novel sheet music turning apparatus is described. A sheet music turning apparatus which can scroll consecutive music pages before a reader is also described. Further shown is a sheet music turning apparatus where the speed at which the pages are scrolled before the reader is controlled by the reader. In addition, a sheet music turning apparatus which can be folded and compactly stored is described. And, lastly, a sheet music turning apparatus which can support numerous pages of sheet music at a particular time is disclosed. Many variations of the present invention will become apparent to those skilled in the art from a reading of the above description and such variations are embodied within the spirit and scope of the present invention s measured by the following appended claims.

What is claimed is:

1. A sheet music turning apparatus comprising:

a base having a first end and a second end;

a first spindle connected on said first end of said base, said first spindle having inner components comprising:

a shaft;

a clutch member located on said shaft;

a drive mounted on said shaft adjacent to said clutch member;

a motor located adjacent to said drive on said shaft; and a power source located adjacent to and in communication with said motor on said shaft;

a second spindle opposite said first spindle on said second end of said base; and, a rotation means for rotating said first spindle in a direction;

whereby a supply of sheet music mounted on said second spindle is transferred to said first spindle by the rotation of said first spindle in a direction, thereby causing consecutive pages of sheet music to be viewed.

2. The sheet music turning apparatus of claim 1, wherein said first end of said base further comprises a first leg, and wherein said second end of said base further comprises a second leg.

3. The sheet music turning apparatus of claim 2, wherein said first leg comprises a first coupling for connecting said first spindle to an electrical source, and wherein said first leg also comprises a second coupling for connecting said first spindle to a remote operation source.

4. The sheet music turning apparatus of claim 1, wherein said base comprises a shelf portion, said shelf portion positioned atop said base, said shelf defining an aperture between said shelf portion and said base, said shelf portion further providing attachment support for said second spindle, said shelf portion further extending around said first spindle.

5. The sheet music turning apparatus of claim 1, wherein said first spindle further comprises a rotating base member, said rotating base member comprising an upper member and a lower member spaced apart from said upper member, said upper member and said lower member having a complimentary diameter.

6. The sheet music turning apparatus of claim 5, wherein said rotating base member further comprises a grooved ring member housed between said upper member and said lower member, said grooved ring member having a diameter which is less than said complimentary diameter of said upper member and said lower member.

7. The sheet music turning apparatus of claim 1, wherein said rotation means comprises a foot pedal in communication with said motor.

8. The sheet music turning apparatus of claim 1, wherein said rotation means comprises a manual means for rotating said first spindle.

9. The sheet music turning apparatus of claim 1, wherein said first spindle further comprises an outer cover, said outer cover providing protection for said inner components, said outer cover further providing a mounting structure for sheet music.

10. The sheet music turning apparatus of claim 1, wherein said second spindle comprises an outer cover, said outer cover having a guide member located adjacent said outer cover.

11. The sheet music turning apparatus of claim 10, wherein said second spindle further comprises a rod member positioned within said outer cover, said rod member further comprising a top member and a bottom member, said top member and said bottom member stabilizing said outer cover in a position.

12. The sheet music turning apparatus of claim 8, wherein said manual means comprises a continuous loop of material.

13. A sheet music turning apparatus comprising:

a collapsible base;

a first spindle on one end of said base, said first spindle having inner components comprising:

a shaft;

a clutch member located on said shaft;

a drive mounted on said shaft adjacent to said clutch member;

a motor located adjacent to said drive on said shaft; and a power source located adjacent to and in communication with said motor on said shaft;

a second spindle opposite said first spindle on said base;

a rotation means for rotating said first spindle; and, an enclosure extending between and spooled on said first spindle and on said second spindle.

14. The sheet music turning apparatus of claim 13, wherein said enclosure is a continuous piece of transparent material.

15. The sheet music turning apparatus of claim 14, wherein said transparent material is segmented into various compartments for holding a sheet of music.

16. The sheet music turning apparatus of claim 13, wherein said enclosure is one continuous envelope.

* * * * *